US009825404B2

(12) United States Patent
Yoshigi et al.

(10) Patent No.: US 9,825,404 B2
(45) Date of Patent: Nov. 21, 2017

(54) CONNECTOR CONNECTING STRUCTURE OF ELECTRONIC CONTROL UNIT AND ELECTRONIC CONTROL UNIT

(71) Applicant: Yazaki Corporation, Tokyo (JP)

(72) Inventors: Toshimasa Yoshigi, Shizuoka (JP); Toshifumi Suzuki, Shizuoka (JP); Kiyotaka Mizuno, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/332,995

(22) Filed: Oct. 24, 2016

(65) Prior Publication Data

US 2017/0117664 A1 Apr. 27, 2017

(30) Foreign Application Priority Data

Oct. 26, 2015 (JP) ..... 2015-209856

(51) Int. Cl.
*H01R 13/62* (2006.01)
*H01R 13/633* (2006.01)
(Continued)

(52) U.S. Cl.
CPC ..... *H01R 13/633* (2013.01); *H01R 12/58* (2013.01); *H01R 13/625* (2013.01); *H01R 13/62977* (2013.01); *H01R 2201/26* (2013.01)

(58) Field of Classification Search
CPC ..... H01R 13/625; H01R 13/623; H01R 13/62938; H01R 13/62933;
(Continued)

(56) References Cited

U.S. PATENT DOCUMENTS 3,745,511 A 7/1973 Fussell
3,892,458 A * 7/1975 Clark ..... H01R 13/623 439/319
(Continued)

FOREIGN PATENT DOCUMENTS

JP 4-134580 A 5/1992
JP 2000-223209 A 8/2000
(Continued)

OTHER PUBLICATIONS

Japanese Office Action for the related Japanese Patent Application No. 2015-209856 dated Sep. 26, 2017.

*Primary Examiner* — Abdullah Riyami
*Assistant Examiner* — Vladimir Imas
(74) *Attorney, Agent, or Firm* — Kenealy Vaidya LLP

(57) ABSTRACT

A connector connecting structure of an electronic control unit includes: a first connector arranged on a radially inner side of a cylinder portion protruding from a casing of an electronic control unit; and a lever member including a pivoting portion mounted to the cylinder portion so as to be rotatable about an axial line of the cylinder portion without changing a position of the pivoting portion with respect to the cylinder portion, and an operation lever portion that extends from the pivoting portion. The first connector includes a connector connecting portion, exposed outward from an opening in the cylinder portion and electrically connected to a connector connecting portion of a second connector protruding from a mounting target for the casing in a manner that the connector connecting portion is accommodated inside the cylinder portion. A bayonet mechanism is provided between the pivoting portion and a housing of the second connector.

4 Claims, 14 Drawing Sheets

(51) Int. Cl.
*H01R 12/58* (2011.01)
*H01R 13/629* (2006.01)
*H01R 13/625* (2006.01)

(58) Field of Classification Search
CPC .. H01R 13/62905; H01R 13/62; H01R 13/64; H01R 2103/00; H01R 13/641; H01R 13/622; H01R 13/629; H01R 13/6276
USPC ..... 439/315, 313, 314, 317, 345
See application file for complete search history.

(56) References Cited

U.S. PATENT DOCUMENTS 3,901,574 A * 8/1975 Paullus ..... H01R 13/623 285/401
4,059,324 A * 11/1977 Snyder ..... H01R 13/623 439/321
4,443,052 A * 4/1984 Eaby ..... H01R 13/622 439/322
4,553,000 A * 11/1985 Appleton ..... H01R 13/629 200/50.29
4,702,537 A * 10/1987 Mattingly ..... H01R 13/625 439/152
4,784,610 A * 11/1988 Stuart ..... H01R 13/633 174/67
5,234,350 A * 8/1993 Marechal ..... H01R 13/4532 439/139
5,423,692 A * 6/1995 Francis ..... H01R 13/213 439/335
5,558,533 A * 9/1996 Hashizawa ..... B60L 11/1818 439/310
5,627,448 A * 5/1997 Okada ..... B60L 3/12 320/109
5,662,488 A * 9/1997 Alden ..... H01R 13/625 439/314
6,336,822 B1 * 1/2002 Luzzoli ..... H01R 13/625 439/314
6,811,422 B1 * 11/2004 Muller ..... H01R 13/625 439/255
6,827,594 B1 * 12/2004 Davis ..... H01R 13/62933 439/157
7,740,499 B1 * 6/2010 Willey ..... H01R 13/625 439/289
7,837,491 B2 * 11/2010 Collin ..... H01R 13/625 439/317
8,177,575 B2 * 5/2012 Katagiyama ..... H01R 13/625 439/345
9,337,582 B2 * 5/2016 Sato ..... H01R 13/6456
9,502,824 B2 * 11/2016 Jordan ..... H01R 13/629
9,601,862 B2 * 3/2017 Fukushima ..... H01R 13/506
2003/0100213 A1 5/2003 Yoshigi et al.
2006/0240698 A1 10/2006 Sanuki et al.
2011/0053398 A1 3/2011 Arai et al.
2014/0335739 A1 * 11/2014 Sato ..... H01R 13/6456 439/680
2015/0072550 A1 3/2015 Yoshigi et al.

FOREIGN PATENT DOCUMENTS

JP 2002-520789 A 7/2002
JP 2003-163056 A 6/2003
JP 2006-332033 A 12/2006
JP 2009-277556 A 11/2009
JP 2013-152848 A 8/2013
JP 2014-13683 A 1/2014
JP 2015-56207 A 3/2015

* cited by examiner

CONNECTOR CONNECTING STRUCTURE OF ELECTRONIC CONTROL UNIT AND ELECTRONIC CONTROL UNIT

CROSS-REFERENCE TO RELATED APPLICATION(S)

The present application claims priority to and incorporates by reference the entire contents of Japanese Patent Application No. 2015-209856 filed in Japan on Oct. 26, 2015.

BACKGROUND OF THE INVENTION

1. Field of the Invention

The present invention relates to a connector connecting structure of an electronic control unit and an electronic control unit.

2. Description of the Related Art

Conventionally, a vehicle has mounted thereon an electronic control unit configured to transmit and receive various kinds of signals, such as control signals and detection signals, to and from a control target (for example, an automatic transmission). The control target and the electronic control unit are connected together with a wire harness (Japanese Patent Application Laid-open No. 2009-277556). The control target and the wire harness are connected together with connectors provided thereto, and the electronic control unit and the wire harness are connected together with connectors provided thereto. For example, a connector connecting structure used for the connection has a bayonet mechanism between the connectors (Japanese Patent Application Laid-open No. 2003-163056 and Japanese Patent Application Laid-open No. 2006-332033). The bayonet mechanism is configured to convert a rotating force of a rotating member provided to one of the connectors into an axial force along a connector connecting direction and transmit the axial force to the two connectors, thereby reducing an operation force by an operator during connector connection. In recent years, some electronic control units are designed to be directly connected to a control target with connectors (Japanese Patent Application Laid-open No. 2015-56207). Also in a connector connecting structure described in Japanese Patent Application Laid-open No. 2015-56207, a bayonet mechanism is provided between the connectors.

In the case where an electronic control unit and a control target are directly connected together with connectors, an operator needs to insert a finger between the electronic control unit and the control target to operate and rotate a rotating member arranged between the electronic control unit and the control target. The conventional connector connecting structure thus has room for improvement in connector connecting workability.

SUMMARY OF THE INVENTION

It is therefore an object of the present invention to provide a connector connecting structure of an electronic control unit capable of improving workability for connector connection, and an electronic control unit.

In order to achieve the above mentioned object, a connector connecting structure of an electronic control unit according to one aspect of the present invention includes a first connector arranged on a radially inner side of a cylindrical cylinder portion that protrudes outward from a casing of an electronic control unit; and a lever member including a cylindrical pivoting portion that is mounted to the cylinder portion so as to be rotatable about an axial line of the cylinder portion without changing a position of the pivoting portion with respect to the cylinder portion in an axial line direction, and an operation lever portion that extends from the pivoting portion, wherein the first connector includes a connector connecting portion, the connector connecting portion being exposed outward from an opening in the cylinder portion in the axial line direction and being electrically connected to a connector connecting portion of a second connector protruding outward from a mounting target for the casing in a manner that the connector connecting portion is accommodated inside the cylinder portion through the opening, and a bayonet mechanism is provided between the pivoting portion and a cylindrical housing of the second connector, the bayonet mechanism being configured to convert a force of the pivoting portion in one direction around the axial line into a force in the axial line direction along a connector connecting direction and connect the connector connecting portion of the first connector and the connector connecting portion of the second connector to each other in a manner that the second connector is accommodated inside the cylinder portion, and convert a force of the pivoting portion in another direction around the axial line into a force in the axial line direction along a connector connection releasing direction and release a connected state of the connector connecting portion of the first connector and the connector connecting portion of the second connector in a manner that the second connector is removed from inside the cylinder portion.

According to another aspect of the present invention, in the connector connecting structure of an electronic control unit, it is desirable that the lever member and the bayonet mechanism are formed so that, after connector connection between the first connector and the second connector is completed, a whole of the lever member is arranged in a space between the casing of the electronic control unit and the mounting target.

According to still another aspect of the present invention, in the connector connecting structure of an electronic control unit, it is desirable that the lever member and the bayonet mechanism are formed so that, after connector connection between the first connector and the second connector is completed, at least a part of an effort portion at a distal end of the operation lever portion protrudes from a space between the casing of the electronic control unit and the mounting target.

According to still another aspect of the present invention, in the connector connecting structure of an electronic control unit, it is desirable to further include a start-point locking mechanism configured such that the lever member is fixed to the cylinder portion at a start-point position at which connector connection between the first connector and the second connector is started, and that a fixed state of the lever member is released along with rotation of the pivoting portion in the connector connecting direction; and an end-point locking mechanism configured such that the lever member is fixed to the cylinder portion at an end-point position at which the connector connection between the first connector and the second connector is completed, and that a fixed state of the lever member is released along with rotation of the pivoting portion in the connector connection releasing direction.

In order to achieve the above mentioned object, an electronic control unit according to still another aspect of the present invention includes a casing having a cylindrical cylinder portion that protrudes outward; a first connector arranged on a radially inner side of the cylinder portion; and a lever member including a cylindrical pivoting portion that is mounted to the cylinder portion so as to be rotatable about an axial line of the cylinder portion without changing a position of the pivoting portion with respect to the cylinder portion in an axial line direction, and an operation lever portion that extends from the pivoting portion, wherein the first connector includes a connector connecting portion, the connector connecting portion being exposed outward from an opening in the cylinder portion in the axial line direction and being electrically connected to a connector connecting portion of a second connector protruding outward from a mounting target for the casing in a manner that the connector connecting portion is accommodated inside the cylinder portion through the opening, and a bayonet mechanism is provided between the pivoting portion and a cylindrical housing of the second connector, the bayonet mechanism being configured to convert a force of the pivoting portion in one direction around the axial line into a force in the axial line direction along a connector connecting direction and connect the connector connecting portion of the first connector and the connector connecting portion of the second connector to each other in a manner that the second connector is accommodated inside the cylinder portion, and convert a force of the pivoting portion in another direction around the axial line into a force in the axial line direction along a connector connection releasing direction and release a connected state of the connector connecting portion of the first connector and the connector connecting portion of the second connector in a manner that the second connector is removed from inside the cylinder portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Referring to the accompanying drawings, a connector connecting structure of an electronic control unit and an electronic control unit according to embodiments of the present invention are described in detail below. The embodiments are not intended to limit the present invention.

Embodiments

Referring to FIG. 1 to FIG. 16, a connector connecting structure of an electronic control unit and an electronic control unit according to one embodiment of the present invention are now described.

Figure 1:
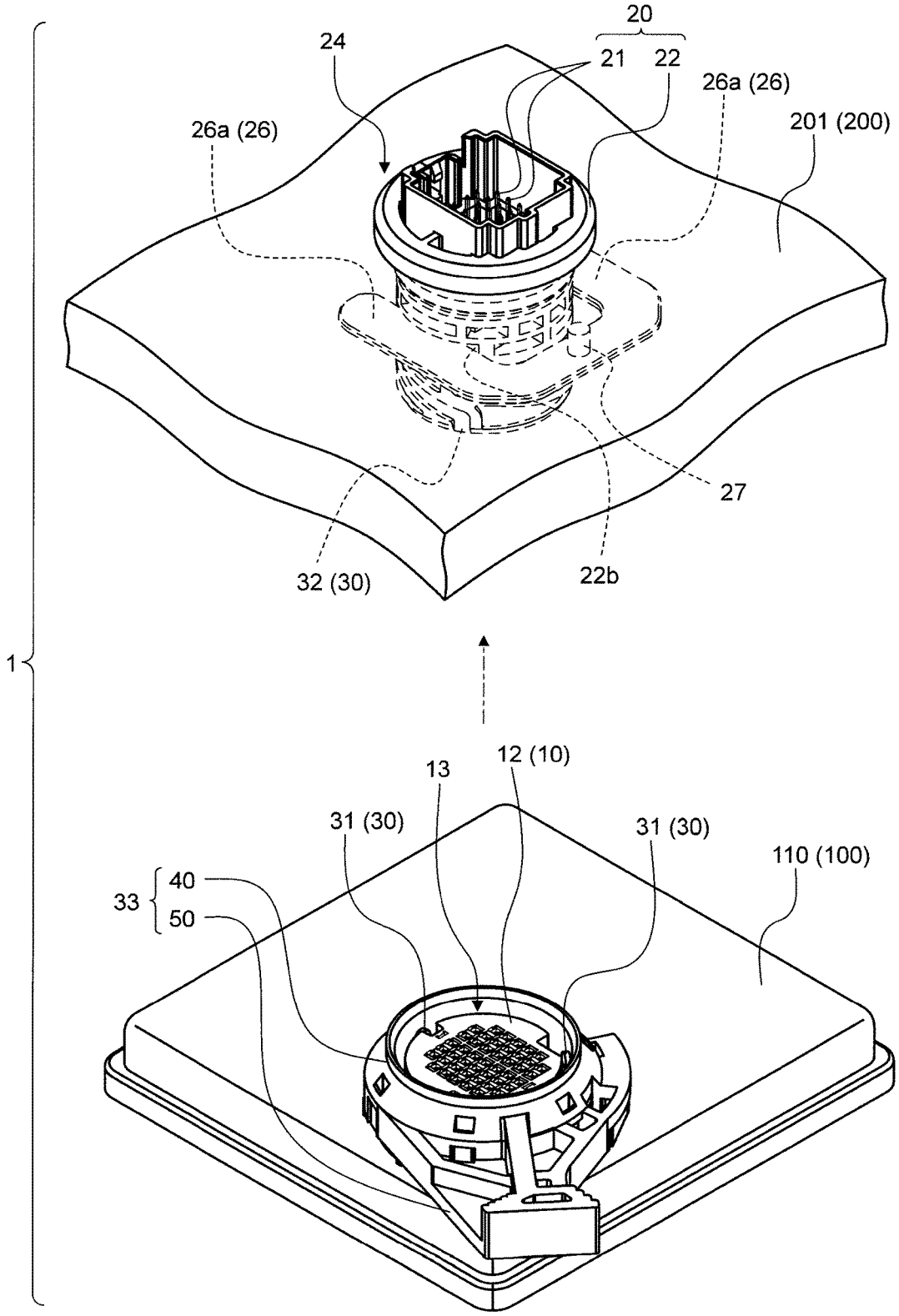
FIG. 1 is a perspective view illustrating a connector connecting structure of an electronic control unit and an electronic control unit according to embodiments in a state before connectors are connected.
Figure 2:
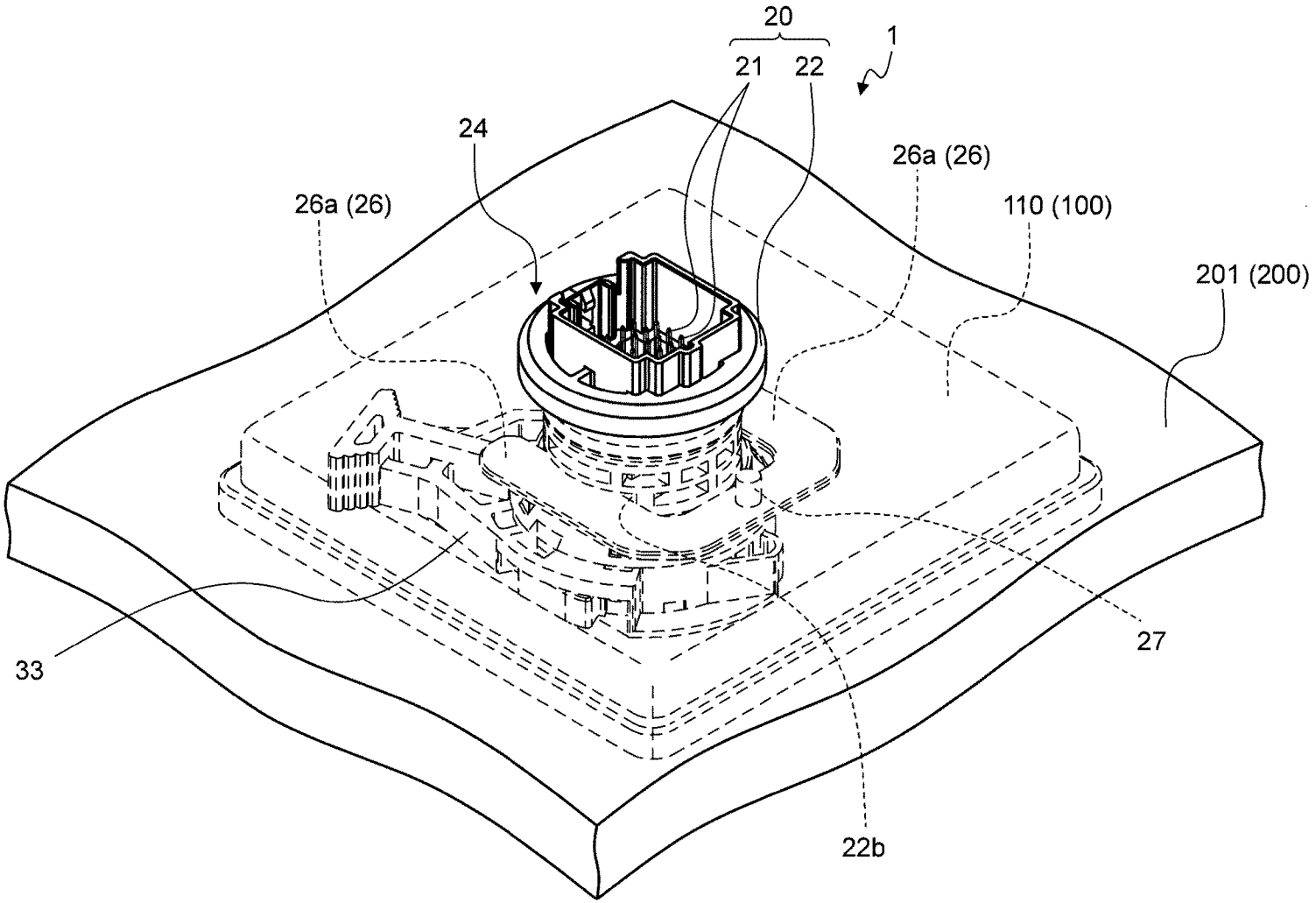
FIG. 2 is a perspective view illustrating the connector connecting structure of the electronic control unit and the electronic control unit according to the embodiments in a state after the connectors are connected.

Reference numeral 1 in FIG. 1 and FIG. 2 denotes the connector connecting structure according to the present embodiment. The connector connecting structure 1 directly connects a first connector 10 provided to an electronic control unit 100 and a second connector 20 provided to a control target 200 for the electronic control unit 100 to each other.

The electronic control unit 100 includes a casing 110 and a unit body (not illustrated). The unit body is accommodated inside the casing 110. The first connector 10 is fixed to the casing 110 so that the first connector 10 is exposed to the outside of the casing 110. The exemplified casing 110 includes an accommodating body having the unit body accommodated and held therein, and a lid body configured to close an opening in the accommodating body. The exemplified first connector 10 is mounted to the lid body and is electrically connected to the unit body. In the casing 110 in the figures, only the lid body is illustrated. The electronic control unit 100 is fixed to the control target 200. The control target 200 thus includes a mounting target 201 to which the casing 110 is to be mounted. The second connector 20 is fixed to the mounting target 201. In the mounting target 201 in the figures, only a portion to which the second connector 20 is mounted and its surroundings are illustrated. For example, the casing 110 is fixed to the mounting target 201 with screws (not illustrated).

Examples of the control target 200 according to the present embodiment include an automatic transmission mounted to a vehicle (not illustrated). The automatic transmission as used herein refers to a transmission capable of automatically shifting gear shift stages (gear shift ratio). Examples of the automatic transmission correspond to a stepped automatic transmission, a continuously variable automatic transmission, a dual clutch transmission (DCT), and a manual transmission capable of automatic gear shifting (what is called automated manual transmission (AMT)). The exemplified control target 200 is thus provided with a transmission case as the mounting target 201, and an electronic control target (not illustrated) such as an actuator (such as a solenoid valve for gear shift control) accommodated in the transmission case. The unit body of the exemplified electronic control unit 100 includes a control circuit configured to control the automatic transmission (control target 200) to execute gear shift control, and transmits and receives signals to and from an electronic control target and a detection target (such as a rotation sensor) of the automatic transmission.

Figure 3:
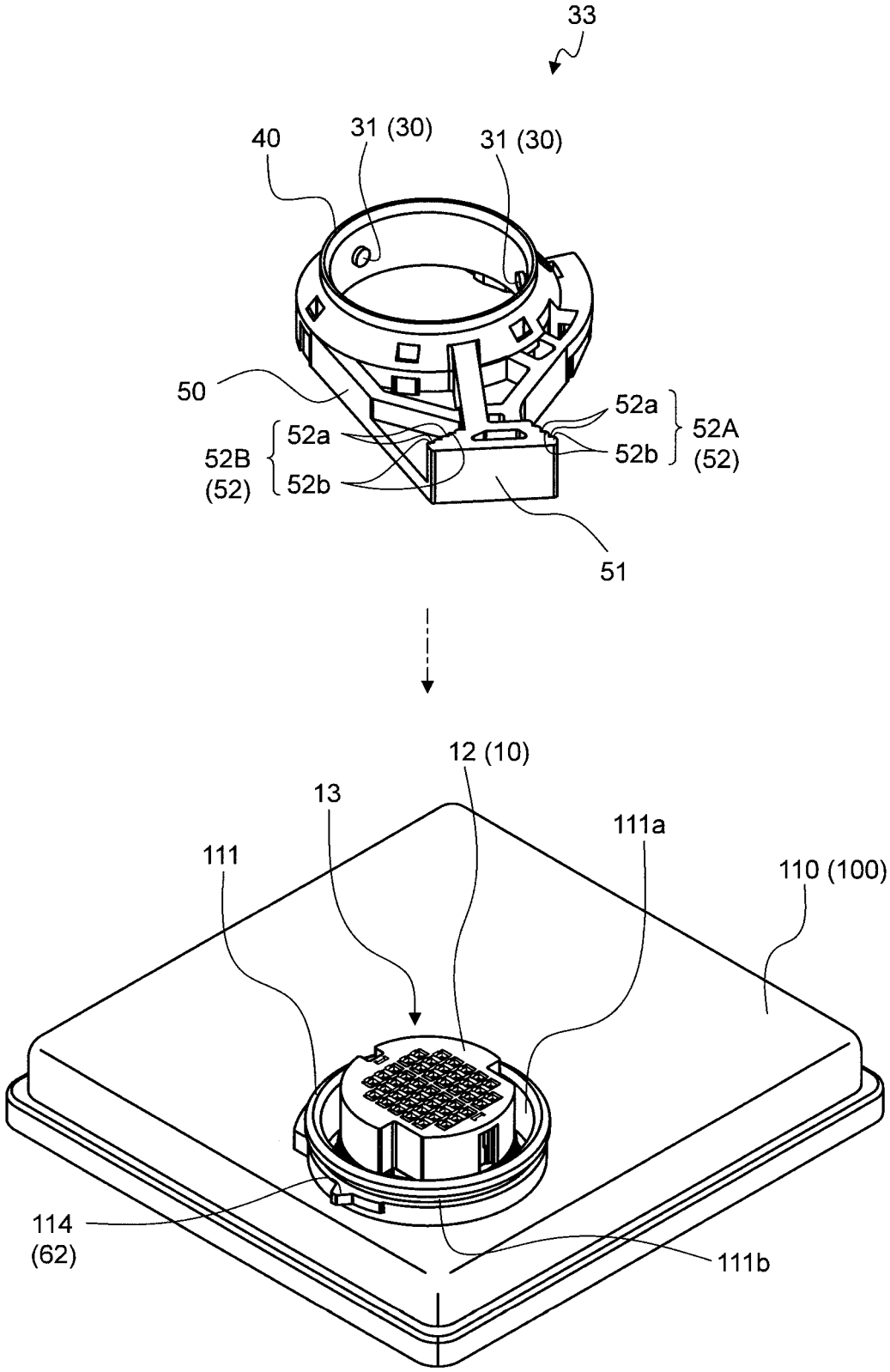
FIG. 3 is an exploded perspective view on a first connector side.

The casing 110 of the electronic control unit 100 is provided with a cylindrical cylinder portion 111 that protrudes outward (FIG. 3). The exemplified cylinder portion 111 is provided to the lid body of the casing 110. The inner side and the outer side of the casing 110 communicate with each other through an opening 111*a* in the cylinder portion 111, which is formed on the protruding side in the axial line direction. In the following, unless specifically mentioned, the direction around the axial line centered at the axial line of the cylinder portion 111 is referred to as "circumferential direction", and the direction orthogonal to the axial line is referred to as "radial direction". The radial direction directed inward is referred to as "radially inner side", and the radial direction directed outward is referred to as "radially outer side".

The first connector 10 includes a plurality of terminals (hereinafter referred to as "first terminals") 11 described later made of a conductive material, and a housing 12 made of an insulating material configured to hold each of the first terminals 11. At least a part of the first connector 10 is arranged on the radially inner side of the cylinder portion 111. In order to electrically connect the unit body provided inside the casing 110 to the control target 200, the exemplified first connector 10 includes a connector connecting portion 13 that is arranged on the radially inner side of the cylinder portion 111 and that is exposed outward from the opening 111*a* in the cylinder portion 111. The connector connecting portion 13 includes a terminal connecting portion to be connected to counterpart terminals for the first terminals 11 (second terminals 21 described later) and a fitting portion to be fitted to a counterpart housing for the housing 12 (housing 22 described later). In the connector connecting structure 1, the axial line direction of the cylinder portion 111 corresponds to a connecting direction of the first connector 10 and the second connector 20. Thus, the connector connecting portion 13 is formed to protrude toward the outside of the casing 110 along the axial line direction of the cylinder portion 111 so as to be connected to a connector connecting portion 23 described later of the second connector 20 in the protruding direction. In the present exemplification, the connector connecting portion 13 protrudes beyond the opening 111*a*.

Figure 4:
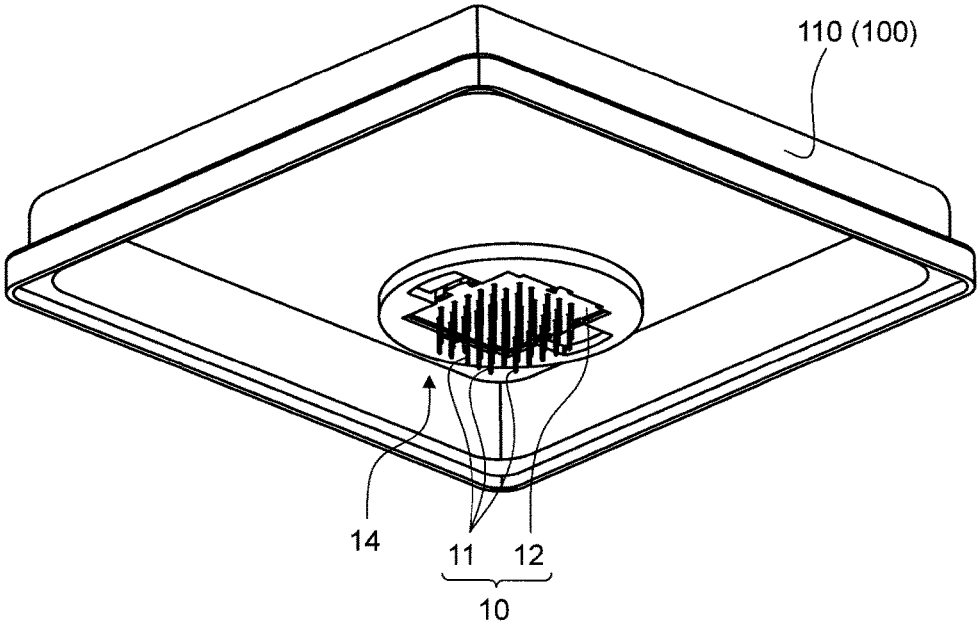
FIG. 4 is a perspective view illustrating a first connector as viewed from inside of a casing of the electronic control unit.

The first connector 10 includes a holding portion 14 configured to hold the connector connecting portion 13 (FIG. 4). The exemplified holding portion 14 is a part of the housing 12, and is continuous to the fitting portion. The first connector 10 is fixed to the casing 110 via the holding portion 14 so that the first connector 10 does not fall off from the casing 110 when the first connector 10 is mounted or removed to or from the second connector 20. The fixation structure may be of any type, and examples thereof include an engagement structure using a pawl, a fitting structure, a screw mechanism, and welding. The housing 12 may be formed integrally with the casing 110 similarly to the cylinder portion 111.

Figure 5:
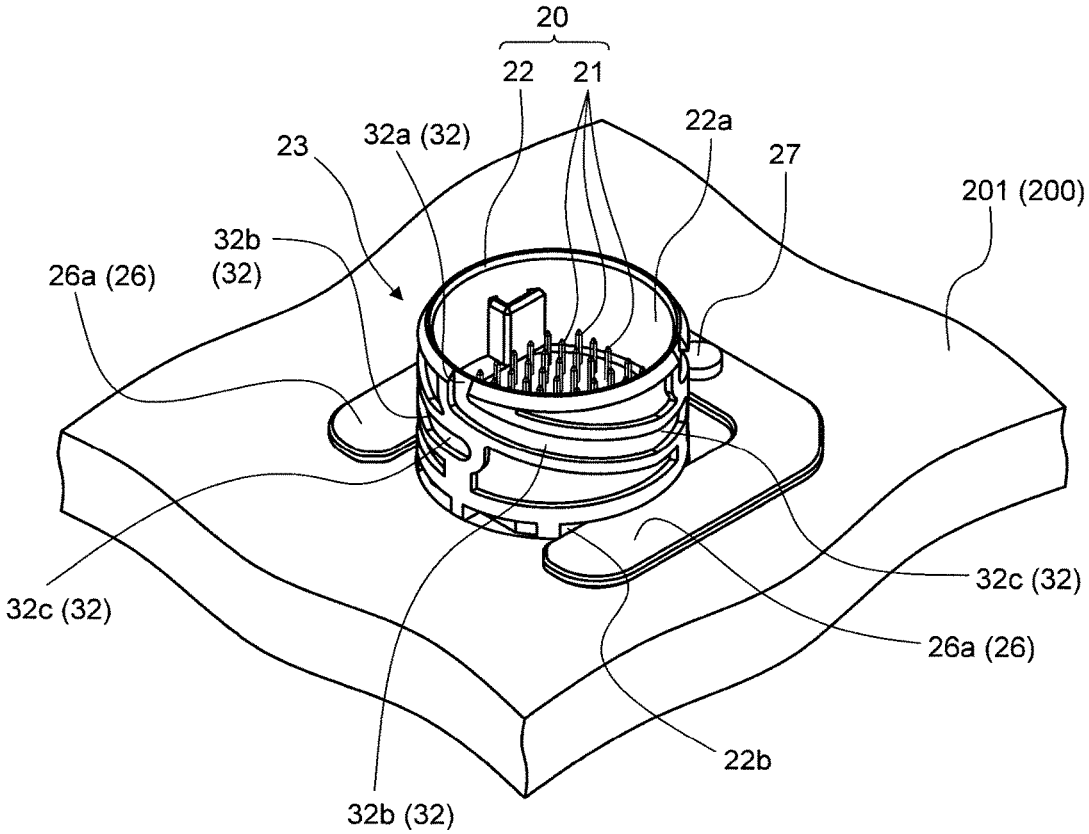
FIG. 5 is a perspective view illustrating a second connector.

The second connector 20 includes a plurality of terminals (hereinafter referred to as "second terminals") 21 described later made of a conductive material, and the housing 22 made of an insulating material configured to hold the second terminals 21 (FIG. 5). The housing 22 is formed into a cylindrical, and holds the second terminals 21 inside. The second connector 20 is electrically connected to a wiring unit provided inside the mounting target 201, and is connected to an electronic control target (such as an actuator) provided inside the mounting target 201 through the wiring unit. In order to electrically connect the electronic control target to the electronic control unit 100, the exemplified second connector 20 includes the connector connecting portion 23 that is exposed to the outside of the mounting target 201 (transmission case). The connector connecting portion 23 includes a terminal connecting portion to be connected to counterpart terminals for the second terminals 21 (first terminals 11) and a fitting portion to be fitted to a counterpart housing for the housing 22 (housing 12), and is electrically connected to the connector connecting portion 13 of the first connector 10. The connector connecting portion 23 protrudes outward from the mounting target 201 along the axial line direction of the housing 22.

In the connector connecting structure 1, the axial line direction of the housing 22 corresponds to the connecting direction of the first connector 10 and the second connector 20. Thus, the cylinder portion 111 and the housing 22 are provided to the casing 110 and the mounting target 201, respectively, so that the cylinder portion 111 and the housing 22 are concentrically arranged when the connectors are connected. In the present exemplification, the connector connecting portions 13 and 23 of the first and second connectors 10 and 20 are fitted together and electrically connected to each other in a manner that the connector connecting portion 23 of the second connector 20 is accommodated inside the cylinder portion 111 through the opening 111*a*.

The second connector 20 includes a holding portion 24 configured to hold the connector connecting portion 23 (FIG. 1 and FIG. 2). The exemplified holding portion 24 is a part of the housing 22, and is continuous to the fitting portion. The second connector 20 is fixed to the mounting target 201 so as not to fall off from the mounting target 201 when mounted and removed to and from the first connector 10. For example, in the second connector 20, the housing 22 is inserted into a through hole (not illustrated) in the mounting target 201 from the fitting portion side along the axial line direction, and hence in order to prevent the second connector 20 from falling off in the insertion direction, an annular locking portion having an outer diameter larger than that of the through hole is provided to the holding portion 24. Furthermore, in order to prevent the second connector 20 from falling off in the direction opposite to the insertion direction, the second connector 20 is provided with a holding member 26 that is engaged with the outer wall of the fitting portion of the housing 22 and sandwiches the mounting target 201 with the locking portion of the holding portion 24 (FIG. 5). The holding member 26 is a member configured to restrict relative movement of a holding target in the axial line direction, such as a C ring. For example, two parallel grooves 22*b* along the wall surface of the mounting target 201 are formed in the outer wall of the fitting portion of the housing 22 at the same position in the axial line direction (FIG. 1 and FIG. 5). The holding member 26 is formed into a U-shaped plate. When two parallel engagement portions 26*a* of the holding member 26 are inserted into the two grooves 22*b*, respectively, the holding member 26 restricts movement of the housing 22 relative to the mounting target 201 in the axial line direction. In the present exemplification, the holding member 26 is fixed to the mounting target 201 with a screw member 27. The housing 22 may be formed integrally with the mounting target 201.

In the connector connecting portions 13 and 23 of the first and second connectors 10 and 20, one of the first terminal 11 and the second terminal 21 is formed as a female terminal, and the other is formed as a male terminal. For example, in the exemplified connector connecting portion 23, a plurality of pin-shaped male terminals (second terminals 21) protruding in the same axial line direction as the housing 22 are arrayed on the radially inner side of the housing 22, and each of the male terminals is exposed outward from an opening 22*a* formed in the housing 22 on the protruding side. Then, in the connector connecting portion 13, a plurality of box-shaped female terminals (first terminals 11) into which the male terminals are to be inserted and held are arrayed. In the connector connecting structure 1, the connector connecting portions 13 and 23 of the first and second connectors 10 and 20 are fitted together and electrically connected to each other in a manner that the connector connecting portion 23 of the second connector 20 is accommodated inside the cylinder portion 111 through the opening 111*a* and the first connector 10 is accommodated inside the housing 22 through the opening 22*a*.

In connecting the first connector 10 and the second connector 20 together, an insertion force between the connector connecting portions 13 and 23 of the first and second connectors 10 and 20 becomes larger as the number of the respective terminals (first terminals 11 and second terminals 21) becomes larger, and hence an operator needs to apply a larger force in the connector connecting direction between the first connector 10 and the second connector 20. A larger insertion force between the connector connecting portions 13 and 23 results in a larger holding force therebetween. For releasing the connected state between the first connector 10 and the second connector 20, the operator thus needs to apply a larger force in the connector connection releasing direction between the first connector 10 and the second connector 20. In view of the above, the connector connecting structure 1 in the present embodiment is provided with a bayonet mechanism 30 in order to reduce a force used by the operator to connect the connectors or release the connector connection (FIG. 1).

The bayonet mechanism 30 includes a protrusion 31 that is provided to one of the cylinder portion (or annular portion) on the first connector 10 side and the cylinder portion (or annular portion) on the second connector 20 side, and a guide groove 32 that is provided to the other. The protrusion 31 and the guide groove 32 are arranged on the outer circumferential surface or the inner circumferential surface of each of the cylinder portions (or annular portions) so that the inserted state of the protrusion 31 and the guide groove 32 in the radial direction is maintained. One of the cylinder portions (or annular portions) is arranged so as to be rotatable around the axial line relative to the connector (first connector 10 or second connector 20) without changing the position thereof in the axial line direction. The bayonet mechanism 30 is configured to change the relative position of the protrusion 31 in the guide groove 32 along with the relative rotation of the cylinder portion (or annular portion), thereby converting a rotating force in response to the relative rotation into a force along the connector connecting direction or the connector connection releasing direction to connect the first connector 10 and the second connector 20 together or release the connected state of the first connector 10 and the second connector 20. The bayonet mechanism 30 according to the present embodiment includes a lever member 33 having a cylinder portion (or annular portion) capable of the relative rotation as described above. Specifically, the bayonet mechanism 30 according to the present embodiment is configured such that the lever member 33 is used to connect the first connector 10 and the second connector 20 together with a small operation force or release the connected state of the first connector 10 and the second connector 20 with a small operation force. In the present exemplification, the lever member 33 including the protrusion 31 is provided on the first connector 10 side, and the guide groove 32 is provided on the second connector 20 side.

First, the lever member 33 is described. The lever member 33 is mounted rotatably to the cylinder portion 111. The lever member 33 includes a cylindrical pivoting portion 40 and an operation lever portion 50.

Figure 6:
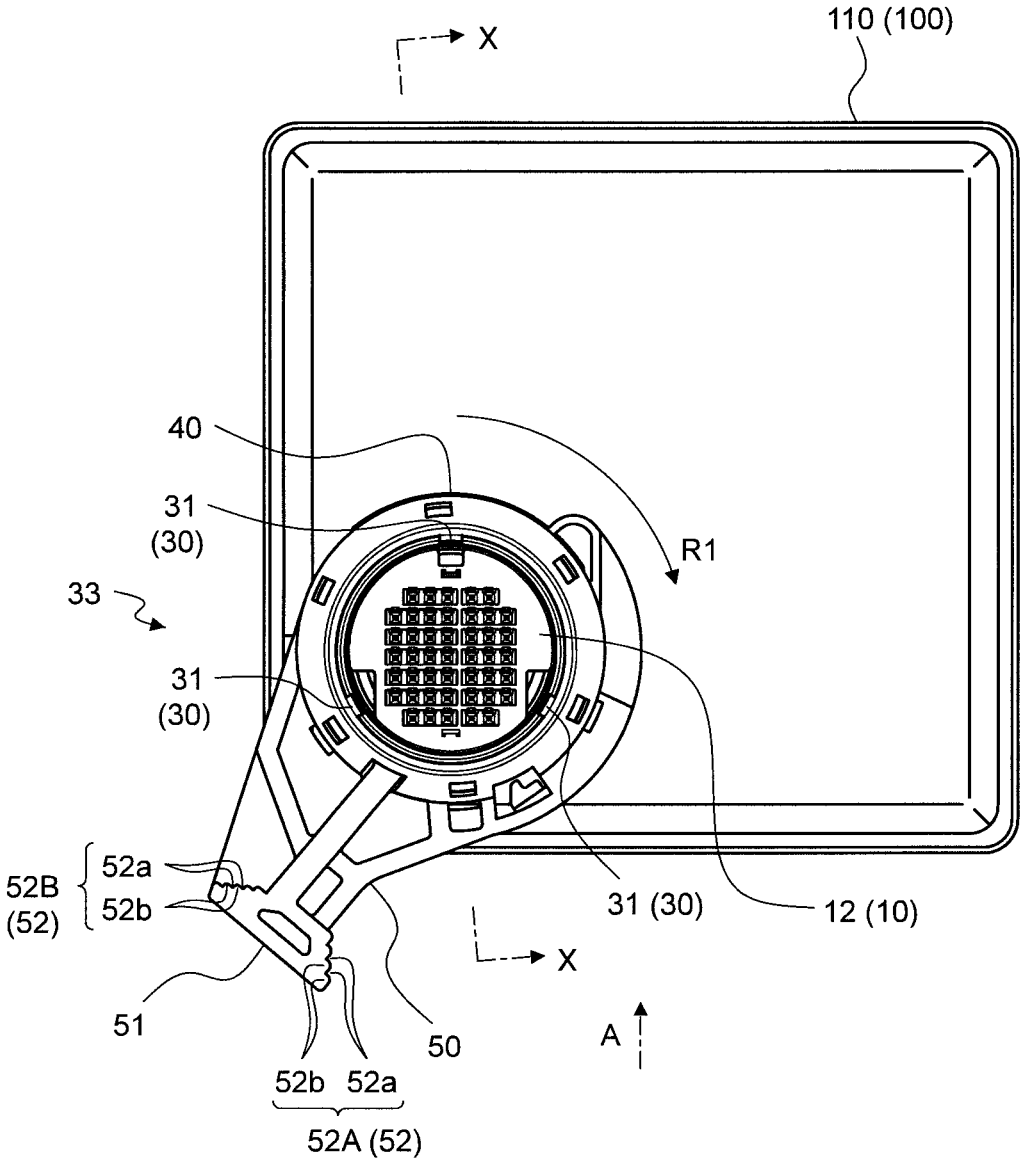
FIG. 6 is a front view illustrating a lever member located at a start-point position.
Figure 7:
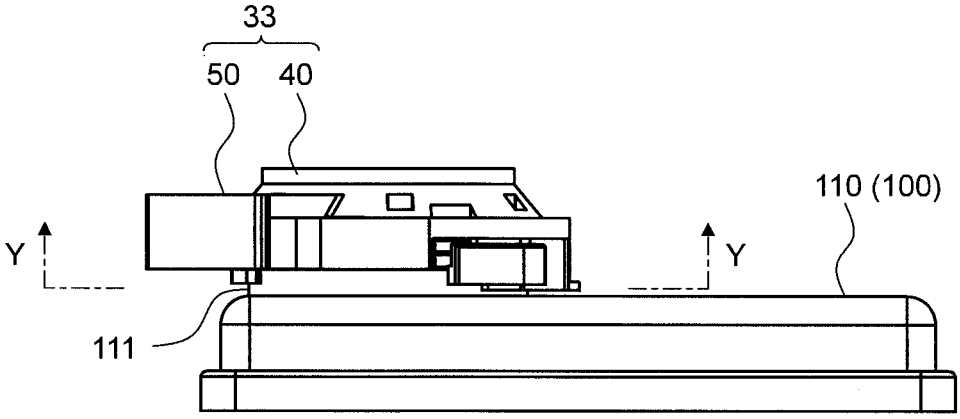
FIG. 7 is a side view illustrating the lever member located at the start-point position as viewed from the direction of the arrow A in FIG. 6.
Figure 8:
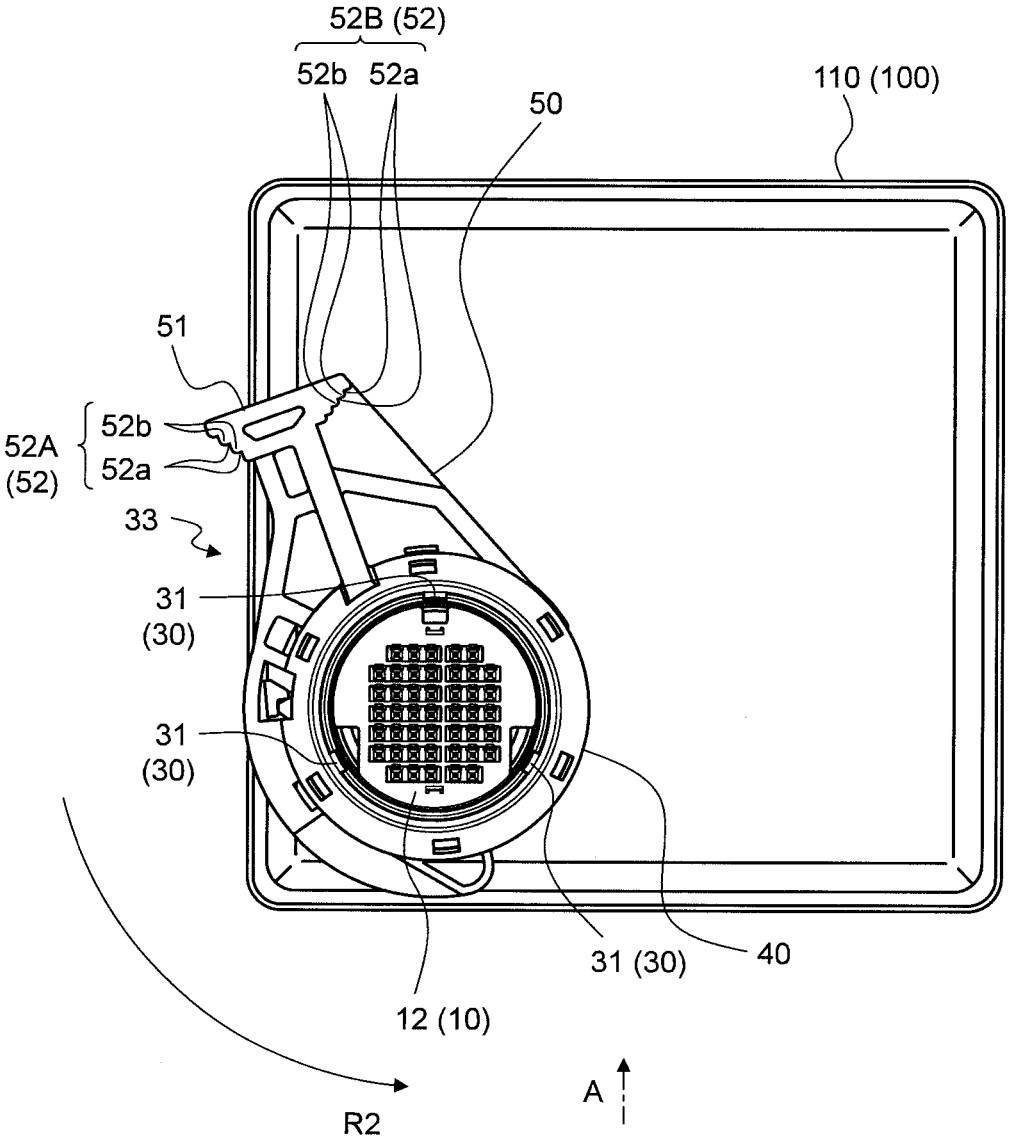
FIG. 8 is a front view illustrating the lever member located at an end-point position.
Figure 9:
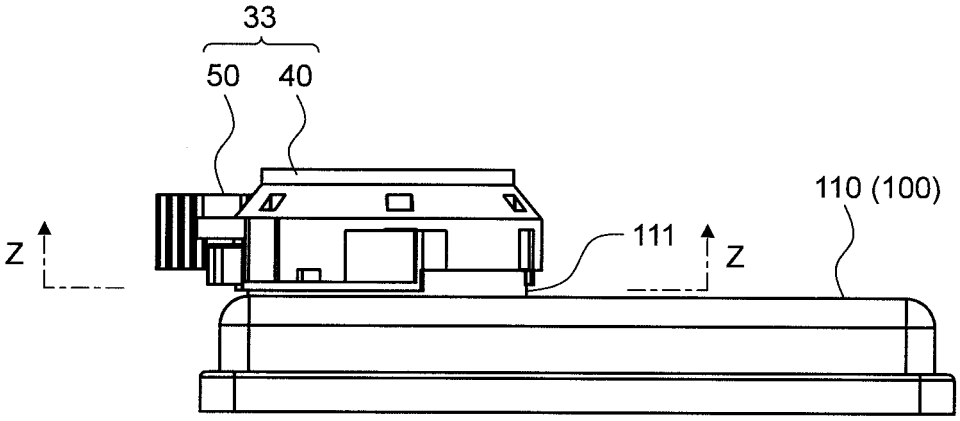
FIG. 9 is a side view illustrating the lever member located at the end-point position as viewed from the direction of the arrow A in FIG. 8.

The pivoting portion 40 is arranged concentrically with the cylinder portion 111 (FIG. 3 and FIGS. 6 to 9), and is mounted so as to be rotatable around the axial line of the cylinder portion 111 without changing the position thereof with respect to the cylinder portion 111 in the axial line direction. The position of the lever member 33 around the axial line relative to the cylinder portion 111 illustrated in FIG. 6 and FIG. 7 indicates a start-point position at which the connector connection between the first connector 10 and the second connector 20 is started. The position of the lever member 33 around the axial line relative to the cylinder portion 111 illustrated in FIG. 8 and FIG. 9 indicates an end-point position at which the connector connection between the first connector 10 and the second connector 20 is completed. In FIG. 6 and FIG. 8, the cylinder portion 111 is covered with the pivoting portion 40.

Figure 10:
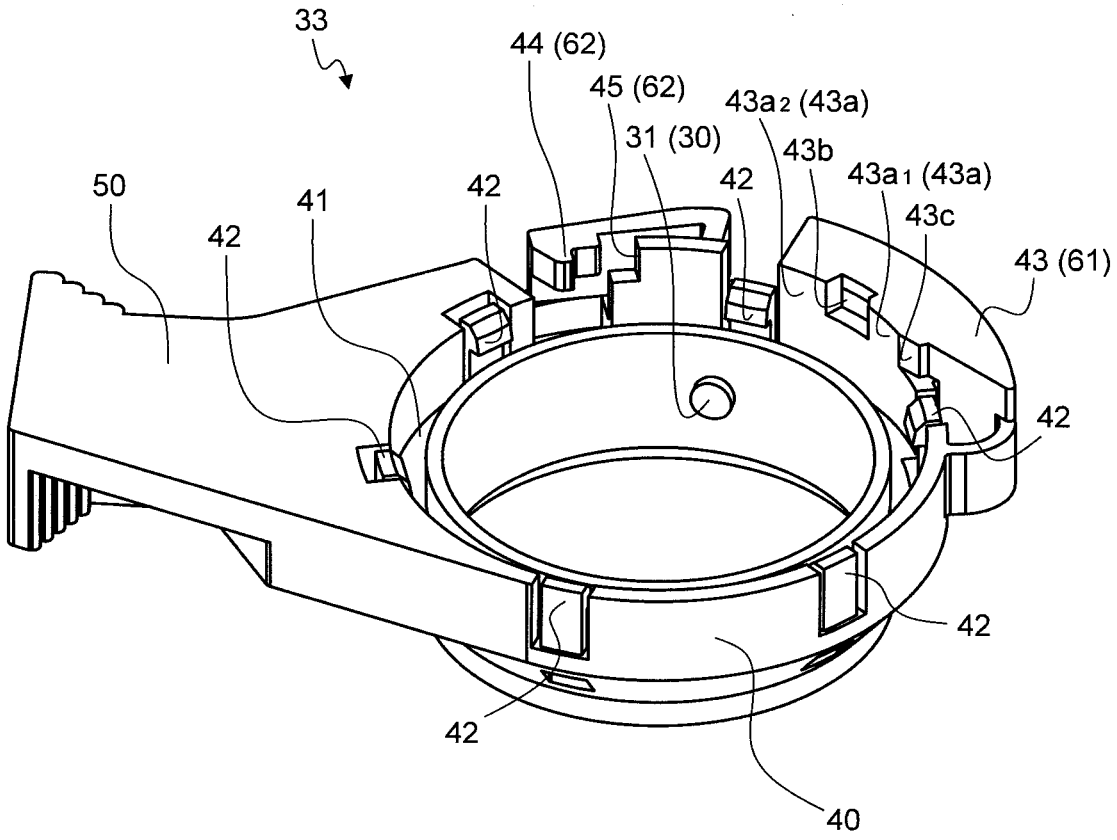
FIG. 10 is a perspective view illustrating the lever member as viewed from the rear surface side.
Figure 11:
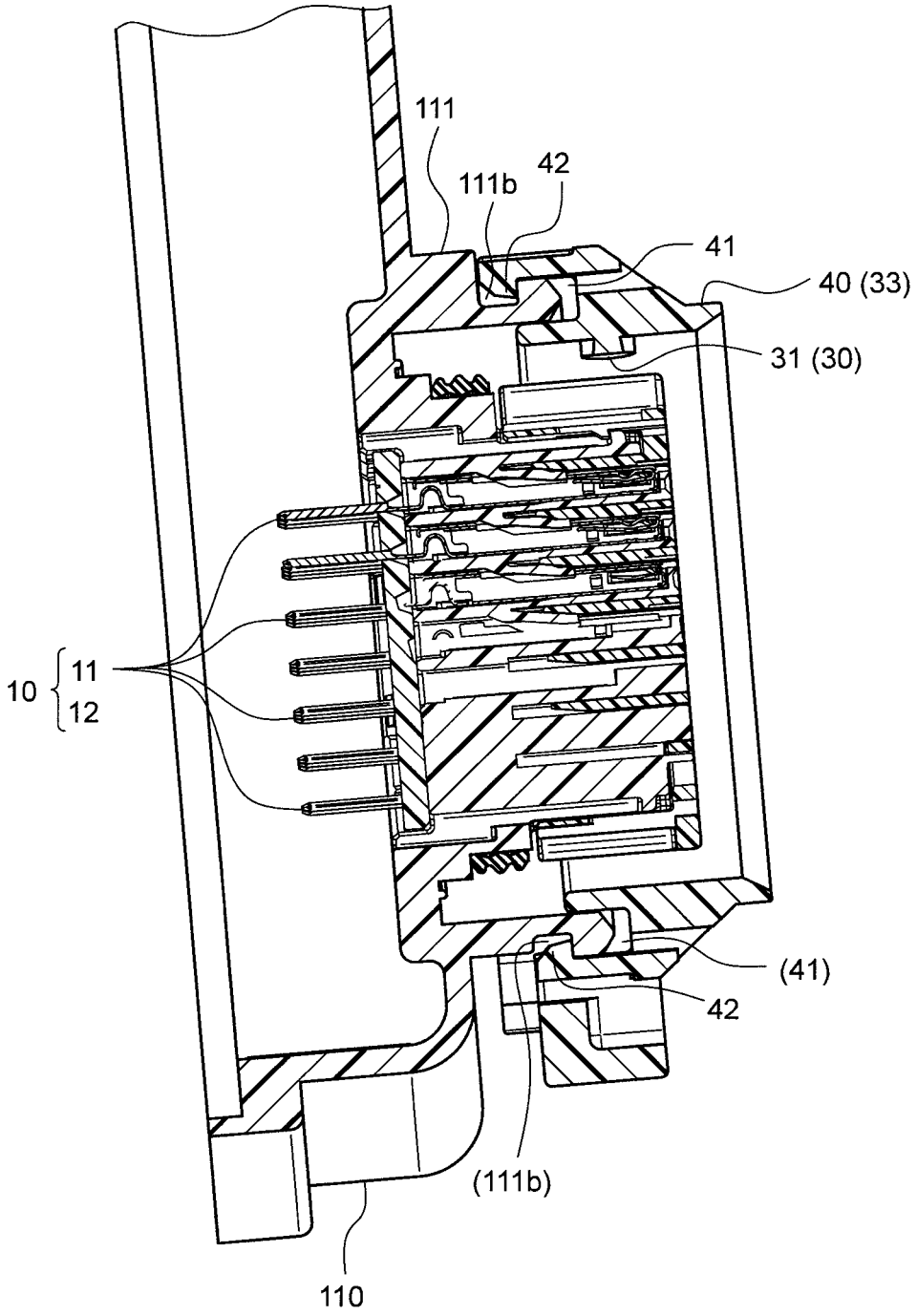
FIG. 11 is a cross-sectional view taken along the line X-X in FIG. 6.

In the pivoting portion 40, a concentric annular groove portion 41 is formed at an end portion on the casing 110 side in the axial line direction (FIG. 10 and FIG. 11). The opening 111*a* side of the cylinder portion 111 is inserted in the groove portion 41 (FIG. 11). Engagement pawls 42, which can be inclined to the radial side and which protrudes toward the radially inner side, are provided to the radially outer wall surface side of the groove portion 41 at a plurality of locations in the circumferential direction. In the present exemplification, the engagement pawls 42 are provided at six locations at equal intervals in the circumferential direction. In the outer circumferential surface of the cylinder portion 111, an annular engagement groove 111*b* into which the engagement pawls 42 are inserted is formed (FIG. 3). The engagement pawls 42 and the engagement groove 111*b* are formed so that the engagement pawls 42 are hooked into the engagement groove 111*b* in the axial line direction when a force in the direction to remove the lever member 33 from the cylinder portion 111 is applied to the lever member 33. Furthermore, the engagement pawls 42 and the engagement groove 111*b* are formed so that the engagement pawls 42 are movable in the circumferential direction along the engagement groove 111*b*. Thus, when the cylinder portion 111 is inserted into the groove portion 41 in the pivoting portion 40 to fit the engagement pawls 42 into the engagement groove 111*b*, the lever member 33 is mounted rotatably to the cylinder portion 111 around the axial line of the cylinder portion 111 without changing the position of the lever member 33 with respect to the cylinder portion 111 in the axial line direction.

The operation lever portion 50 is a portion used by the operator to connect the first connector 10 and the second connector 20 together, and extends from the pivoting portion 40. The exemplified operation lever portion 50 extends from the outer circumferential surface of the pivoting portion 40 along a plane orthogonal to the axial line of the pivoting portion 40. In the operation lever portion 50, the operator uses a distal end portion in the extending direction as an effort portion 51 to be operated with a finger. By moving the effort portion 51 by pushing or pulling the effort portion 51, the operator can operate and move the lever member 33 around the axial line of the cylinder portion 111. In this case, the operation of rotating the lever member 33 in one circumferential direction corresponds to a connector connecting operation for connecting the first connector 10 and the second connector 20 together, and the operation of rotating the lever member 33 in the other circumferential direction corresponds to a connector connection releasing operation for releasing the connected state of the first connector 10 and the second connector 20. The arrow R1 in FIG. 6 indicates the operation direction for the connector connecting operation. The arrow R2 in FIG. 8 indicates the operation direction for the connector connection releasing operation.

The effort portion 51 at the distal end of the operation lever portion 50 is provided with a hook portion 52 used by the operator to hook a finger. At the hook portion 52, a plurality of recessed portions 52*a* and a plurality of protruding portions 52*b* for enhancing a friction coefficient generated between a finger and the hook portion 52 more than in other regions of the operation lever portion 50 are formed. The recessed portions 52*a* and the protruding portions 52*b* are alternately arranged so as to extend in the direction orthogonal to the movement of a finger in the rotating operation in order to prevent a slip of the finger in the rotating operation. As the hook portion 52, a first hook portion 52A to be used in the connector connecting operation and a second hook portion 52B to be used in the connector connection releasing operation are provided.

The bayonet mechanism 30 is provided between the pivoting portion 40 of the lever member 33 and the housing 22 of the second connector 20. The bayonet mechanism 30 converts a force of the pivoting portion 40 in one direction around the axial line (rotating force in response to connector connecting operation) into a force in the axial line direction along the connector connecting direction (hereinafter referred to as "axial force"), and connects the connector connecting portions 13 and 23 of the first and second connectors 10 and 20 together in a manner that the second connector 20 is accommodated inside the cylinder portion 111. Furthermore, the bayonet mechanism 30 converts a force of the pivoting portion 40 in the other direction around the axial line (rotating force in response to connector connection releasing operation) into an axial force along the connector connection releasing direction, and releases the connected state of the connector connecting portions 13 and 23 of the first and second connectors 10 and 20 in a manner that the second connector 20 is removed from inside the cylinder portion 111. The bayonet mechanisms 30 are desirably provided at a plurality of locations. In the present exemplification, the bayonet mechanisms 30 are provided at three locations at substantially equal intervals around the axial line.

The protrusion 31 of the bayonet mechanism 30 is provided to the pivoting portion 40 of the lever member 33. The protrusion 31 protrudes from the inner circumferential surface of the pivoting portion 40 to the radially inner side. The exemplified protrusion 31 is formed into a column whose axial line direction is aligned with the radial direction. The protrusions 31 are provided on the inner circumferential surface of the pivoting portion 40 at three locations at substantially equal intervals in the circumferential direction.

The guide groove 32 in the bayonet mechanism 30 is a groove into which the protrusions 31 are to be inserted and which is configured to guide the protrusions 31 along with the rotation of the pivoting portion 40. The guide groove 32 is provided in the outer circumferential surface of the housing 22 of the second connector 20 (FIG. 1 and FIG. 5). The guide grooves 32 are provided in the outer circumferential surface at three locations at substantially equal intervals in the circumferential direction.

Specifically, the guide groove 32 includes an axial groove portion 32*a* along the axial line direction at an end portion of the housing 22 in the protruding direction. One end of the axial groove portion 32*a* is opened to an annular end surface of the housing 22 in the protruding direction. For connecting the first connector 10 and the second connector 20 together, the protrusion 31 is inserted from the opening part of the axial groove portion 32*a*. For separating the first connector 10 and the second connector 20 from each other, the protrusion 31 is removed from the opening part of the axial groove portion 32*a*.

The guide groove 32 further includes an inclined groove portion 32*b* that is spirally formed on the outer circumferential surface of the housing 22 from one end side of the housing 22 in the axial line direction (end portion side in protruding direction) toward the other end side (mounting target 201 side). The inclined groove portion 32*b* is spirally extended, starting from the other end of the axial groove portion 32*a* (end portion on the opposite side from the opening part). One end of the inclined groove portion 32*b* communicates with the other end of the axial groove portion 32*a*. Accordingly, after the protrusion 31 is inserted into the axial groove portion 32*a* through the opening part, the protrusion 31 is locked at the other end of the axial groove portion 32*a*. In the present embodiment, the locking position is referred to as "operation starting position" of the bayonet mechanism 30 when the connectors are connected. For example, distal ends of the connector connecting portions 13 and 23 of the first and second connectors 10 and 20 may be engaged with each other when the protrusion 31 is located at the locking position. In order to improve connector connection workability of the operator until the protrusion 31 reaches the locking position, an insertion force desirably does not act between the first connector 10 and the second connector 20 until the protrusion 31 reaches the locking position. Thus, in the present exemplification, the other end of the axial groove portion 32*a* and one end of the inclined groove portion 32*b* in the axial line direction on the outer circumferential surface of the housing 22 are arranged so as to prevent an insertion force from acting between the connector connecting portions 13 and 23 of the first and second connectors 10 and 20. In contrast, the other end of the inclined groove portion 32*b* in the axial line direction on the outer circumferential surface of the housing 22 is arranged so that the protrusion 31 reaches the other end when the connection between the connector connecting portions 13 and 23 of the first and second connectors 10 and 20 is completed.

The guide groove 32 further includes a circumferential groove portion 32*c* that extends in the circumferential direction, starting from the other end of the inclined groove portion 32*b*. The circumferential groove portion 32*c* extends in the circumferential direction directed in the above-mentioned extending direction of the inclined groove portion 32*b*. One end of the circumferential groove portion 32*c* communicates with the other end of the inclined groove portion 32*b*. For connector connection, the lever member 33 is rotated to a predetermined position as described later. Thus, the other end of the circumferential groove portion 32*c* is arranged so that the protrusion 31 reaches the other end when the lever member 33 is rotated to the predetermined position.

Figure 12:
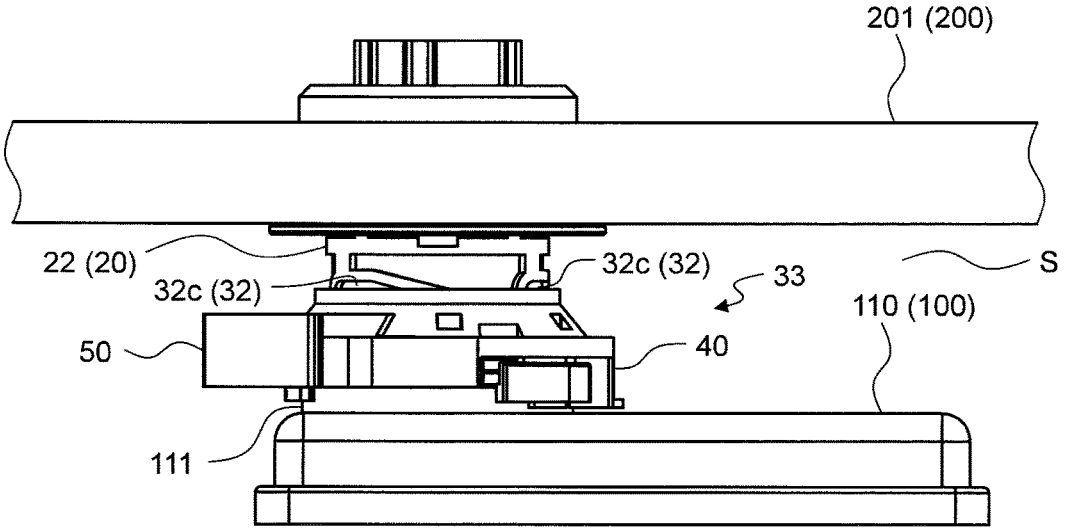
FIG. 12 is a side view illustrating the course of connector connection when the lever member is located at the start-point position as viewed from the direction of the arrow A in FIG. 6.
Figure 13:
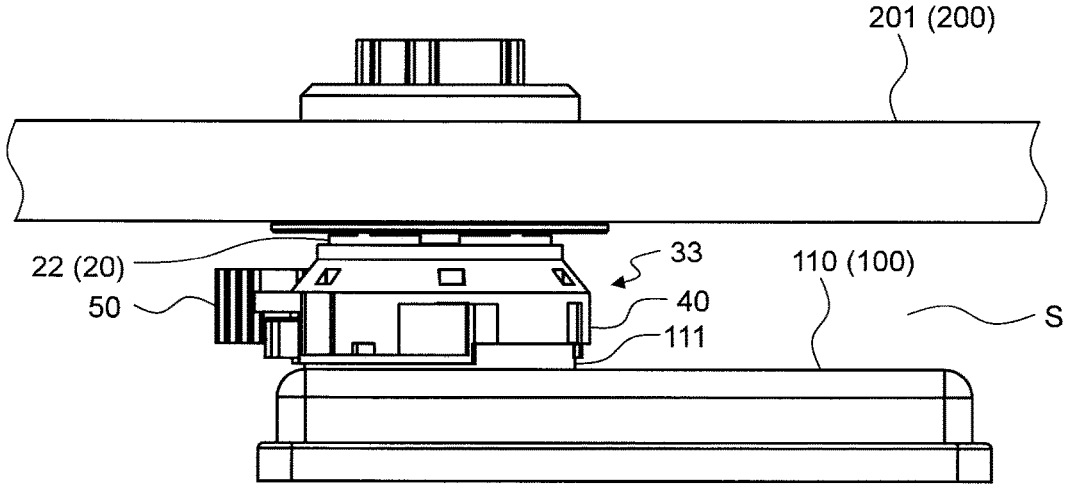
FIG. 13 is a side view illustrating a connector connection completed state in which the lever member is located at the end-point position as viewed from the direction of the arrow A in FIG. 8.

For connector connection, the operator inserts the second connector 20 inside the cylinder portion 111 while holding the electronic control unit 100, and accordingly the protrusion 31 of the pivoting portion 40 is inserted into the axial groove portion 32*a* in the housing 22 through the opening part (FIG. 12). In this case, the protrusion 31 is locked at the other end of the axial groove portion 32*a*, and hence the insertion of the second connector 20 inside the cylinder portion 111 is stopped once. In the bayonet mechanism 30, when the operator operates and rotates the lever member 33 in the connector connecting direction at this position (operation starting position of bayonet mechanism 30), the protrusion 31 applies a pushing force to the side wall of the inclined groove portion 32*b* while the protrusion 31 is guided along the inclined groove portion 32*b* from one end to the other end thereof, and hence a rotating force of the operator applied to the lever member 33 is converted into an axial force in the connector connecting direction to insert the connector connecting portion 13 into the connector connecting portion 23. The connection of the connector connecting portions 13 and 23 of the first and second connectors 10 and 20 is completed when the protrusion 31 reaches the other end of the inclined groove portion 32*b*. In the bayonet mechanism 30, when the operator continues to operate and rotate the lever member 33, the lever member 33 is rotated to a predetermined position while the protrusion 31 is guided along the circumferential groove portion 32*c* to the other end side thereof (FIG. 8 and FIG. 13). After that, the operator fixes the casing 110 of the electronic control unit 100 and the mounting target 201 together with screws, for example.

For releasing the connector connection, on the other hand, the operator releases the fixation between the casing 110 of the electronic control unit 100 and the mounting target 201, and operates and rotates the lever member 33 in the connector connection releasing direction, so that the protrusion 31 is guided along the circumferential groove portion 32*c* to one end side thereof. In the bayonet mechanism 30, the protrusion 31 reaches one end of the circumferential groove portion 32*c*, and then when the operator continues to operate and rotate the lever member 33, the protrusion 31 applies a pushing force to the side wall of the inclined groove portion 32*b* while the protrusion 31 is guided along the inclined groove portion 32*b* from the other end to one end thereof. Accordingly, the rotating force of the operator applied to the lever member 33 is converted into an axial force in the connector connection releasing direction to pull the connector connecting portion 13 out of the connector connecting portion 23. The connection of the connector connecting portions 13 and 23 of the first and second connectors 10 and 20 is released when the protrusion 31 reaches one end of the inclined groove portion 32*b*. The protrusion 31 is locked at one end of the inclined groove portion 32*b* (that is, the other end of the axial groove portion 32*a*), and hence a further rotation of the lever member 33 is restricted (FIG. 6 and FIG. 12). In this case, by pulling the electronic control unit 100 to be separated from the mounting target 201, the operator removes the protrusion 31 from the opening part of the axial groove portion 32*a* to remove the second connector 20 from inside the cylinder portion 111, thereby completing the release of the connector connection.

As described above, the connector connecting structure 1 and the electronic control unit 100 according to the present embodiment include the lever member 33 exemplified above, which is used as a constituent of the bayonet mechanism 30. Consequently, connector connection and connector connection release can be achieved with a force smaller than hitherto, and workability for connector connection and connector connection release can be improved.

Figure 14:
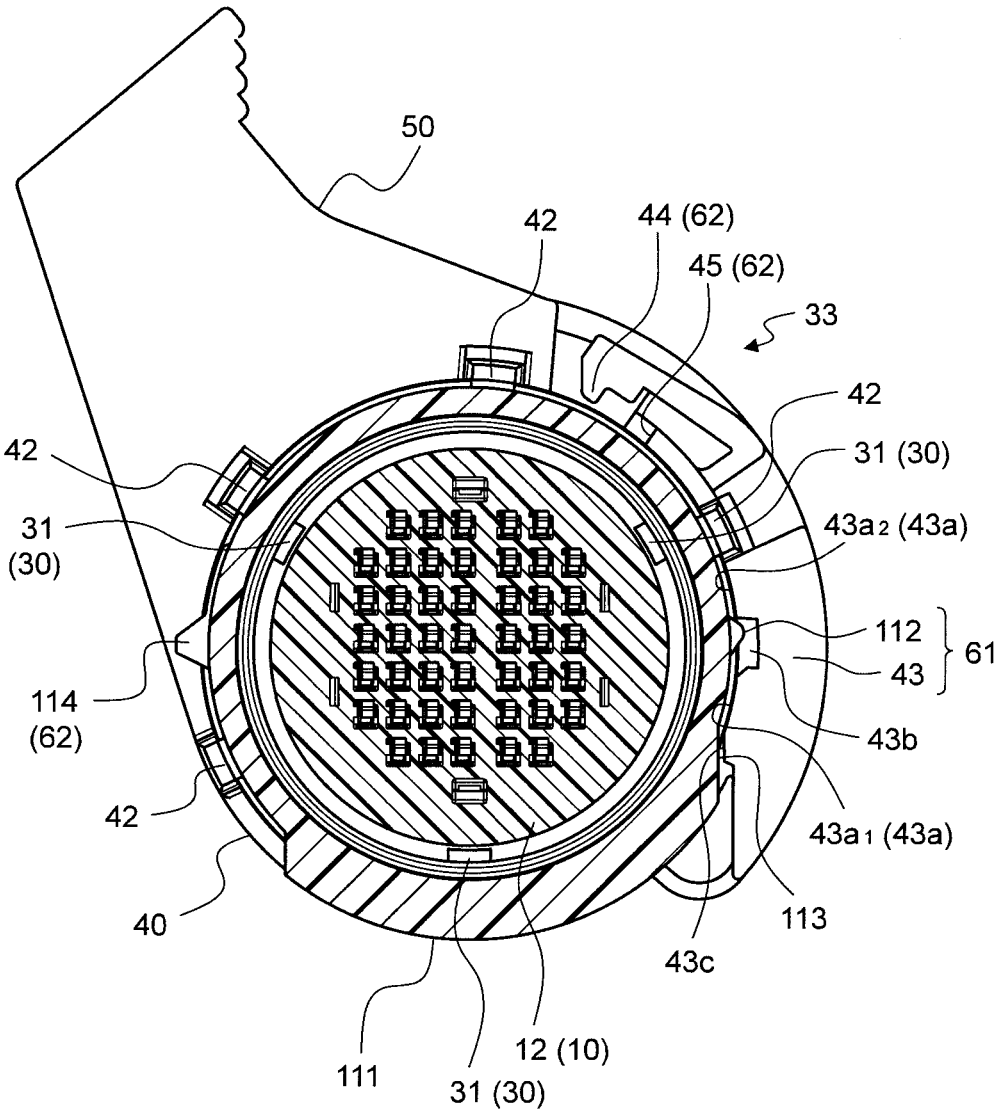
FIG. 14 is a cross-sectional view taken along the line Y-Y in FIG. 7.

In the connector connecting structure 1 according to the present embodiment, in order to improve the workability for inserting and removing the protrusion 31 into and from the axial groove portion 32*a*, the position of the protrusion 31 (that is, the position of the lever member 33) with respect to the cylinder portion 111 is fixed at the position at which the protrusion 31 can be inserted and removed into and from the axial groove portion 32*a*. Such a position of the lever member 33 with respect to the cylinder portion 111 is referred to as "start-point position" at which the connector connection is started. The start-point position corresponds to the position of the lever member 33 with respect to the cylinder portion 111 at which the protrusion 31 can be guided along the axial groove portion 32*a*, specifically, the electronic control unit 100 is mounted and removed to and from the mounting target 201. Thus, it can also be said that the start-point position is the position corresponding to the operation starting position of the bayonet mechanism 30 for connector connection. The connector connecting structure 1 includes a start-point locking mechanism 61 configured such that the lever member 33 is fixed to the cylinder portion 111 at the start-point position and that the fixed state of the lever member 33 is released along with the rotation of the pivoting portion 40 in the connector connecting direction (FIG. 14).

Specifically, the start-point locking mechanism 61 is provided between the casing 110 of the electronic control unit 100 and the lever member 33. In the present exemplification, the start-point locking mechanism 61 is provided between the cylinder portion 111 and the pivoting portion 40. The start-point locking mechanism 61 includes a locking protrusion (hereinafter referred to as "first locking protrusion") 112 that protrudes from the outer circumferential surface of the cylinder portion 111 to the radially outer side, and a locking portion 43 that is provided to the pivoting portion 40 and configured to lock the first locking protrusion 112 at the start-point position of the lever member 33.

The first locking protrusion 112 has an inverted V-shaped wall surface whose feet are located on the outer circumferential surface of the cylinder portion 111 at two locations in the circumferential direction. The locking portion 43 has an inner circumferential surface 43*a* that is opposed to the outer circumferential surface of the cylinder portion 111 in the radial direction (FIG. 10). In the inner circumferential surface 43*a*, a locking groove 43*b* into which the first locking protrusion 112 is to be inserted is formed. The exemplified locking groove 43*b* divides the inner circumferential surface 43*a* into a first inner circumferential surface $\mathbf{43}a_1$ and a second inner circumferential surface $\mathbf{43}a_2$ in the circumferential direction, and locks the first locking protrusion 112 at a circumferential wall surface of the locking groove 43*b*.

In the start-point locking mechanism 61, the shapes of the first locking protrusion 112 and the locking portion 43 (such as the protruding amount and the foot shape of the first locking protrusion 112, and the radial position of the inner circumferential surface 43*a* with respect to the outer circumferential surface of the cylinder portion 111) are set so that the inner circumferential surface 43*a* of the locking portion 43 may climb over the first locking protrusion 112 along with the rotation of the pivoting portion 40. Furthermore, the first locking protrusion 112 and the locking groove 43*b* are arranged so that the position, at which the first inner circumferential surface 43$a_1$ has climbed over the first locking protrusion 112 so that the first locking protrusion 112 has entered the locking groove 43*b* as a result of the rotating operation of the lever member 33 in the connector connection releasing direction, is the start-point position of the lever member 33 with respect to the cylinder portion 111. Then, the backlash amount between the first locking protrusion 112 and the locking groove 43*b* in the circumferential direction is set within the range where the protrusion 31 can be inserted into the axial groove portion 32*a* through the opening part.

In the start-point locking mechanism 61, locking wall portions 113 and 43*c*, configured to be locked together in the circumferential direction so as to prevent the second inner circumferential surface 43$a_2$ from climbing over the first locking protrusion 112 and the lever member 33 from being excessively rotated from the start-point position in the connector connection releasing direction, are provided to the outer circumferential surface of the cylinder portion 111 and the inner circumferential surface 43*a* of the locking portion 43, respectively (FIG. 14).

In the start-point locking mechanism 61, the first inner circumferential surface 43$a_1$ can climb over the first locking protrusion 112 when a rotating force in the connector connecting direction is applied to the lever member 33 located at the start-point position. Accordingly, the fixed state of the lever member 33 at the start-point position with respect to the cylinder portion 111 can be released to rotate the lever member 33 relative to the cylinder portion 111. Thus, the operator can operate and rotate the lever member 33 from the start-point position in the connector connecting direction, thereby connecting the connectors together. In contrast, in the start-point locking mechanism 61, when the first inner circumferential surface 43$a_1$ climbs over the first locking protrusion 112 along with the rotating operation of the lever member 33 in the connector connection releasing direction, the first locking protrusion 112 is inserted into the locking groove 43*b* so that the lever member 33 is fixed at the start-point position with respect to the cylinder portion 111. Accordingly, the fixed state of the lever member 33 at the start-point position is maintained unless the rotating force in the connector connecting direction is applied to the lever member 33. Consequently, in the connector connecting structure 1 and the electronic control unit 100 according to the present embodiment, the workability for inserting and removing the protrusion 31 into and from the axial groove portion 32*a* is improved.

Figure 15:
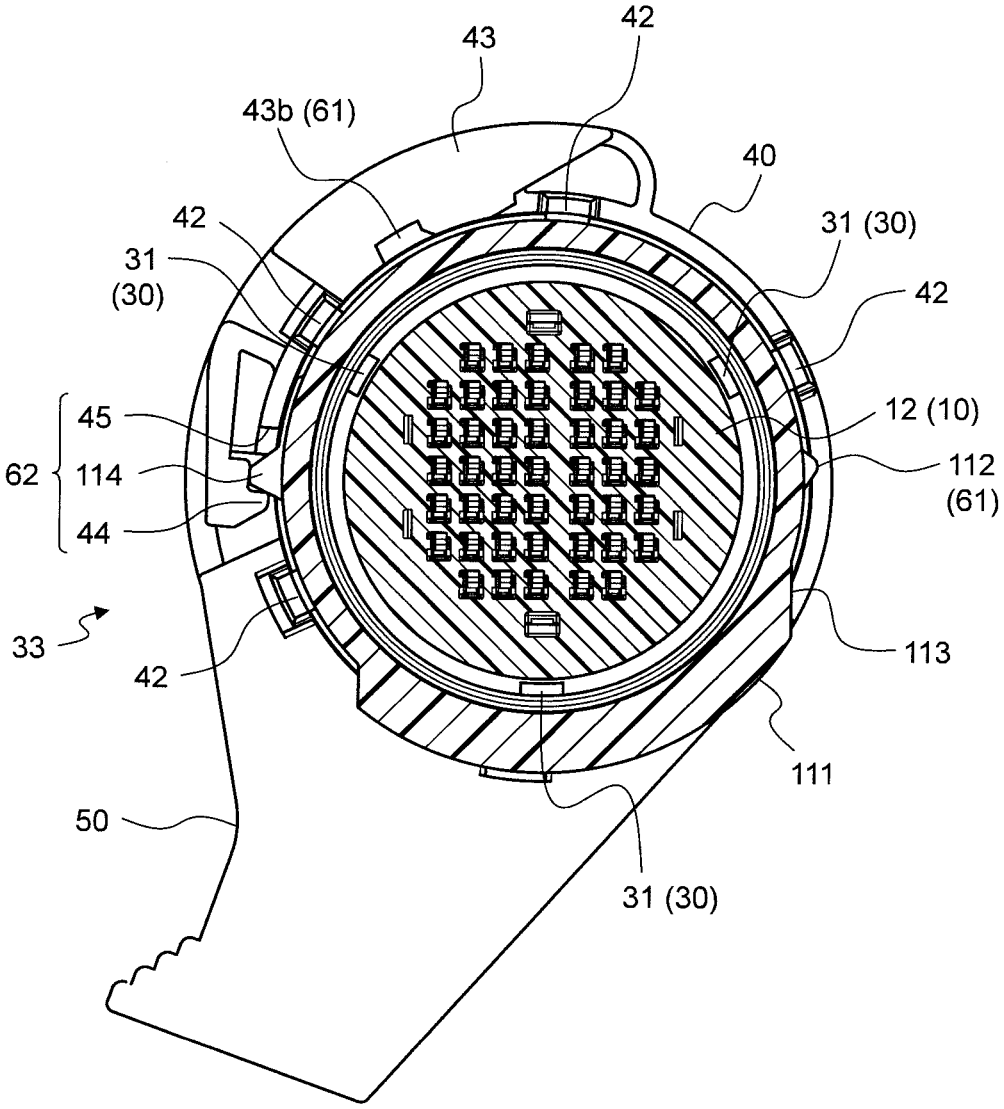
FIG. 15 is a cross-sectional view taken along the line Z-Z in FIG. 9.

The connector connecting structure 1 according to the present embodiment is formed so that the lever member 33 does not move in the release direction and does not unintentionally release the connector connection after the connector connection is completed. After the connector connection is completed, the lever member 33 is fixed to the cylinder portion 111 at a predetermined position with respect to the cylinder portion 111. The predetermined position of the lever member 33 with respect to the cylinder portion 111 is assumed as an end-point position after the completion of the connector connection. The connector connecting structure 1 includes an end-point locking mechanism 62 configured such that the lever member 33 is fixed to the cylinder portion 111 at the end-point position and that the fixed state of the lever member 33 is released along with the rotation of the pivoting portion 40 in the connector connection releasing direction (FIG. 15).

Specifically, the end-point locking mechanism 62 is provided between the casing 110 of the electronic control unit 100 and the lever member 33. In the present exemplification, the end-point locking mechanism 62 is provided between the cylinder portion 111 and the pivoting portion 40. The end-point locking mechanism 62 includes a locking protrusion (hereinafter referred to as "second locking protrusion") 114 that protrudes from the outer circumferential surface of the cylinder portion 111 to the radially outer side, a locking pawl 44 that is provided to the pivoting portion 40 and that is capable of climbing over the second locking protrusion 114 from any circumferential direction along with the rotation of the pivoting portion 40, and a locking wall portion 45 that is provided to the pivoting portion 40 and configured to sandwich the second locking protrusion 114 with the locking pawl 44 at the end-point position of the lever member 33 with respect to the cylinder portion 111.

The second locking protrusion 114 has an inverted V-shaped wall surface whose feet are located on the outer circumferential surface of the cylinder portion 111 at two locations in the circumferential direction. The second locking protrusion 114 is arranged at a position shifted from the first locking protrusion 112 by about 180 degrees around the axial line. The locking pawl 44 is arranged so as to bring the position thereof in the axial line direction to the same position as the second locking protrusion 114. The locking pawl 44 protrudes toward the outer circumferential surface of the cylinder portion 111. The protruding amounts of the second locking protrusion 114 and the locking pawl 44 are set so that the locking pawl 44 can climb over the second locking protrusion 114 along with the rotation of the pivoting portion 40. In the present exemplification, the protruding amount of the second locking protrusion 114 is larger than the protruding amount of the first locking protrusion 112 in order to enhance the force of the lever member 33 for holding the cylinder portion 111 more at the end-point position than at the start-point position. The second locking protrusion 114 and the locking pawl 44 are arranged so that the position, at which the locking pawl 44 has climbed over the second locking protrusion 114 as a result of the rotating operation of the lever member 33 in the connector connecting direction, is the end-point position of the lever member 33 with respect to the cylinder portion 111. The locking wall portion 45 has a wall surface that is opposed to the locking pawl 44 in the circumferential direction at the same position in the axial line direction and that is capable of sandwiching the second locking protrusion 114 with the locking pawl 44 when the lever member 33 is located at the end-point position. When the second locking protrusion 114 is locked between the locking pawl 44 and the locking wall portion 45, the rotation of the pivoting portion 40 relative to the cylinder portion 111 is restricted, and hence the lever member 33 is fixed at the end-point position with respect to the cylinder portion 111. The backlash amounts between the second locking protrusion 114 and the locking pawl 44 and between the second locking protrusion 114 and the locking wall portion 45 in the circumferential direction are set, for example, within the range where the position of the lever member 33 in a space between the casing 110 of the electronic control unit 100 and the mounting target 201 can be held.

In the end-point locking mechanism 62, when the locking pawl 44 climbs over the second locking protrusion 114 along with the rotating operation of the lever member 33 in the connector connecting direction, the second locking protrusion 114 is sandwiched between the locking pawl 44 and the locking wall portion 45 so that the lever member 33 is fixed at the end-point position with respect to the cylinder portion 111. Thus, the fixed state of the lever member 33 at the end-point position is maintained unless a rotating force in the connector connection releasing direction is applied to the lever member 33. Consequently, in the connector connecting structure 1 and the electronic control unit 100 according to the present embodiment, an unintended release of connector connection by a vehicle user is prevented. In the end-point locking mechanism 62, when the rotating force in the connector connection releasing direction is applied to the lever member 33 located at the end-point position, the locking pawl 44 can climb over the second locking protrusion 114, and hence the fixed state of the lever member 33 at the end-point position with respect to the cylinder portion 111 can be released to rotate the lever member 33 relative to the cylinder portion 111. Consequently, the operator can operate and rotate the lever member 33 from the end-point position in the connector connection releasing direction, thereby releasing the connector connection.

If the lever member 33 at the end-point position protrudes from a space S (FIG. 12 and FIG. 13) between the casing 110 of the electronic control unit 100 and the mounting target 201, when an operator, a peripheral component, or the like touches the protruding part of the lever member 33, the lever member 33 may operate in the connector connection releasing direction to unintentionally release the connector connection. In this case, other components cannot be arranged in this place because of the protruding part of the lever member 33. Thus, mountability of other components as well as the connector connecting structure 1 and the electronic control unit 100 to a vehicle may be decreased.

In view of the above, the lever member 33 and the bayonet mechanism 30 are desirably formed so that a whole of the lever member 33 is arranged in the space S between the casing 110 of the electronic control unit 100 and the mounting target 201 after the connector connection is completed. For example, in the bayonet mechanism 30, the position of the other end of the circumferential groove portion 32*c* is set so that the lever member 33 is arranged as described above. In the case where this arrangement cannot be achieved even when the position of the other end of the circumferential groove portion 32*c* is extended as much as possible, the shape of the lever member 33 is set so that the lever member 33 is accommodated in the space S. Consequently, the connector connecting structure 1 and the electronic control unit 100 according to the present embodiment can prevent the lever member 33 from protruding from the space S, thus preventing an unintentional release of the connector connection, and preventing a decrease in mountability of other components as well as the connector connecting structure 1 and the electronic control unit 100 to a vehicle.

Figure 16:
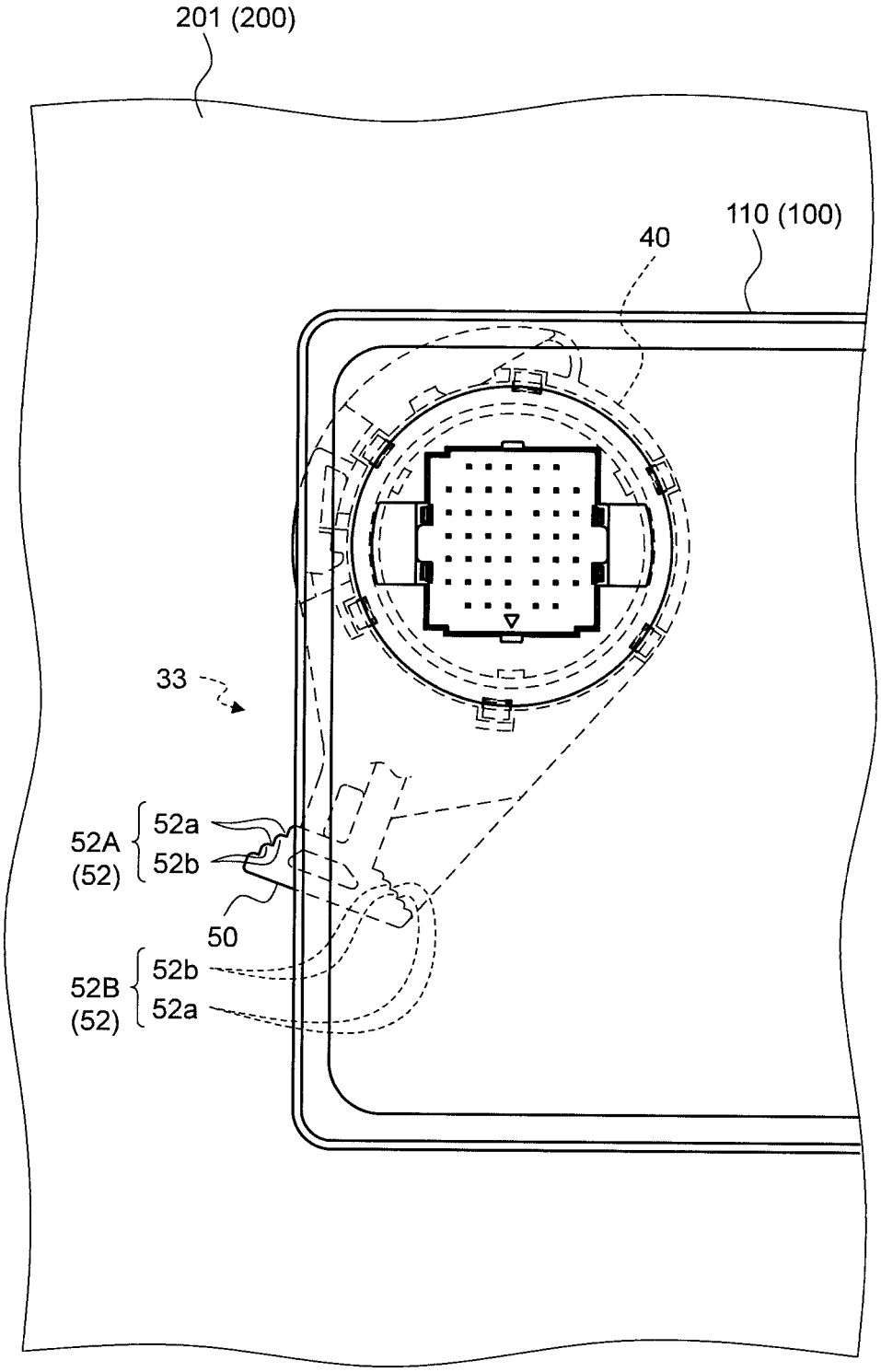
FIG. 16 is a rear view illustrating the connector connection completed state in which the lever member is located at the end-point position as viewed from the electronic control unit side.

In contrast, in the case where the lever member 33 is completely accommodated in the space S, if a clearance between the casing 110 and the mounting target 201 is so narrow that a finger cannot be inserted therebetween, a finger cannot reach the second hook portion 52B in the connector connection releasing operation, which may make the connector connection releasing operation difficult. Accordingly, when such a situation is expected, the lever member 33 and the bayonet mechanism 30 are desirably formed so that, after the connector connection is completed, at least a part of the effort portion 51 at the distal end of the operation lever portion 50 protrudes from the space S between the casing 110 of the electronic control unit 100 and the mounting target 201 to enable a finger to reach the second hook portion 52B (FIG. 16). For example, in the bayonet mechanism 30, the position of the other end of the circumferential groove portion 32*c* is set so that the lever member 33 is arranged as described above. In the case where this arrangement cannot be achieved even when the position of the other end of the circumferential groove portion 32*c* is extended as much as possible, the shape of the lever member 33 is set so that at least a part of the effort portion 51 protrudes from the space S to the position that enables a finger to reach the second hook portion 52B. Consequently, the connector connecting structure 1 and the electronic control unit 100 according to the present embodiment can ensure operability for releasing the connector connection and prevent an unintentional release of the connector connection and a decrease in mountability of other components as well as the connector connecting structure 1 and the electronic control unit 100 to a vehicle.

The connector connecting structure of an electronic control unit and the electronic control unit according to the embodiment include a lever member used as a constituent of a bayonet mechanism. Consequently, connector connection and connector connection release can be achieved with a force smaller than hitherto, and workability for connector connection and connector connection release can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector connecting structure of an electronic control unit, comprising:

a first connector arranged on a radially inner side of a cylindrical cylinder portion that protrudes outward from a casing of an electronic control unit; and a lever member including a cylindrical pivoting portion that is mounted to the cylinder portion so as to be rotatable about an axial line of the cylinder portion without changing a position of the pivoting portion with respect to the cylinder portion in an axial line direction, and an operation lever portion that extends from the pivoting portion, wherein the first connector includes a connector connecting portion, the connector connecting portion being exposed outward from an opening in the cylinder portion in the axial line direction and being electrically connected to a connector connecting portion of a second connector protruding outward from a mounting target for the casing in a manner that the connector connecting portion is accommodated inside the cylinder portion through the opening, and a bayonet mechanism is provided between the pivoting portion and a cylindrical housing of the second connector, the bayonet mechanism being configured to convert a force of the pivoting portion in one direction around the axial line into a force in the axial line direction along a connector connecting direction and connect the connector connecting portion of the first connector and the connector connecting portion of the second connector to each other in a manner that the second connector is accommodated inside the cylinder portion, and convert a force of the pivoting portion in another direction around the axial line into a force in the axial line direction along a connector connection releasing direction and release a connected state of the connector connecting portion of the first connector and the connector connecting portion of the second connector in a manner that the second connector is removed from inside the cylinder portion; and further comprising:

a start-point locking mechanism configured such that the lever member is fixed to the cylinder portion at a start-point position at which connector connection between the first connector and the second connector is started, and that a fixed state of the lever member is released along with rotation of the pivoting portion in the connector connecting direction; and an end-point locking mechanism configured such that the lever member is fixed to the cylinder portion at an end-point position at which the connector connection between the first connector and the second connector is completed, and that a fixed state of the lever member is released along with rotation of the pivoting portion in the connector connection releasing direction.

2. The connector connecting structure of an electronic control unit according to claim 1, wherein the lever member and the bayonet mechanism are formed so that, after connector connection between the first connector and the second connector is completed, a whole of the lever member is arranged in a space between the casing of the electronic control unit and the mounting target.

3. The connector connecting structure of an electronic control unit according to claim 1, wherein the lever member and the bayonet mechanism are formed so that, after connector connection between the first connector and the second connector is completed, at least a part of an effort portion at a distal end of the operation lever portion protrudes from a space between the casing of the electronic control unit and the mounting target.

4. An electronic control unit comprising a casing having a cylindrical cylinder portion that protrudes outward;

a first connector arranged on a radially inner side of the cylinder portion; and a lever member including a cylindrical pivoting portion that is mounted to the cylinder portion so as to be rotatable about an axial line of the cylinder portion without changing a position of the pivoting portion with respect to the cylinder portion in an axial line direction, and an operation lever portion that extends from the pivoting portion, wherein the first connector includes a connector connecting portion, the connector connecting portion being exposed outward from an opening in the cylinder portion in the axial line direction and being electrically connected to a connector connecting portion of a second connector protruding outward from a mounting target for the casing in a manner that the connector connecting portion is accommodated inside the cylinder portion through the opening, and a bayonet mechanism is provided between the pivoting portion and a cylindrical housing of the second connector, the bayonet mechanism being configured to convert a force of the pivoting portion in one direction around the axial line into a force in the axial line direction along a connector connecting direction and connect the connector connecting portion of the first connector and the connector connecting portion of the second connector to each other in a manner that the second connector is accommodated inside the cylinder portion, and convert a force of the pivoting portion in another direction around the axial line into a force in the axial line direction along a connector connection releasing direction and release a connected state of the connector connecting portion of the first connector and the connector connecting portion of the second connector in a manner that the second connector is removed from inside the cylinder portion; and further comprising:

a start-point locking mechanism configured such that the lever member is fixed to the cylinder portion at a start-point position at which connector connection between the first connector and the second connector is started, and that a fixed state of the lever member is released along with rotation of the pivoting portion in the connector connecting direction; and an end-point locking mechanism configured such that the lever member is fixed to the cylinder portion at an end-point position at which the connector connection between the first connector and the second connector is completed, and that a fixed state of the lever member is released along with rotation of the pivoting portion in the connector connection releasing direction.

* * * * *